US010995923B1

(12) United States Patent
Lessard et al.

(10) Patent No.: US 10,995,923 B1
(45) Date of Patent: May 4, 2021

(54) VEHICLE LAMP BASE HAVING INTEGRALLY FORMED SPRING TO BIAS REFLECTOR

(71) Applicants: Jason Lessard, Bow, NH (US); Blair Weiss, Peterborough, NH (US); Richard Holland, Stoddard, NH (US)

(72) Inventors: Jason Lessard, Bow, NH (US); Blair Weiss, Peterborough, NH (US); Richard Holland, Stoddard, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 17/020,660

(22) Filed: Sep. 14, 2020

Related U.S. Application Data

(60) Provisional application No. 63/069,691, filed on Aug. 24, 2020.

(51) Int. Cl.
*F21S 41/19* (2018.01)
*F21V 19/04* (2006.01)
*F21S 41/30* (2018.01)

(52) U.S. Cl.
CPC ..... *F21S 41/196* (2018.01); *F21S 41/192* (2018.01); *F21S 41/30* (2018.01); *F21V 19/047* (2013.01)

(58) Field of Classification Search
CPC ..... F21S 41/196; F21S 41/30; F21S 41/192; F21V 19/047
USPC ..... 362/548, 549
See application file for complete search history.

(56) References Cited

U.S. PATENT DOCUMENTS 4,740,876 A 4/1988 Roller
5,711,597 A * 1/1998 Unno ..... F21S 41/196 362/640
5,855,430 A * 1/1999 Coushaine ..... H01K 1/46 362/519
5,957,569 A 9/1999 Helbig et al.
(Continued)

FOREIGN PATENT DOCUMENTS

CN 207438161 U 6/2018
DE 10 2007 015 925 A 10/2008

OTHER PUBLICATIONS

US Dept. of Transportation public document National Highway Traffic Safety Administration (NHTSA) Memorandum dated Jun. 26, 2002 archiving in the public record the Osram Sylvania Inc. specification under Part 564, Replaceable Light Source Information, and containing ten data and drawing sheets H13-0 to H13-9 (Jun. 26, 2002).

*Primary Examiner* — Anabel Ton
(74) *Attorney, Agent, or Firm* — Edward S. Podszus

(57) ABSTRACT

A vehicle lamp capsule 32 having a base 34 having a spring 5 which, when lamp capsule 32 is installed, biases an inner surface of a vehicle lamp reflector 12. Spring 5 is monolithically formed with base 34 along with at least one reflector-locating structure on the base such as circumferentially extending exterior locating surface 44 and/or retaining keys 42. Base 34 and spring 5 may be molded of a plastics material. In other embodiments base 34 and spring 5 are made in one piece of sheet metal. The spring 5 formed unitary with the lamp base 34 meets regulatory requirements and avoids a risk of dislodgement of a conventional separate piece-part metal spring which could cause an electrical short when the lamp is installed in the field. The lamp capsule 32 is suitably an H13-style lamp.

20 Claims, 15 Drawing Sheets

(56) References Cited

U.S. PATENT DOCUMENTS

| | | | | |
|---|---|---|---|---|
| 6,254,252 | B1 | 7/2001 | Coushaine et al. | |
| 6,290,986 | B1 | 9/2001 | Murdock et al. | |
| 9,739,439 | B2 | 8/2017 | Landcastle | |
| 9,939,119 | B2 * | 4/2018 | Lessard | F21S 43/195 |
| 10,066,801 | B1 | 9/2018 | Rice | |
| 2006/0098443 | A1 | 5/2006 | Kaandorp | |
| 2011/0286224 | A1 * | 11/2011 | Nomura | F21V 19/0005 362/396 |

* cited by examiner

VEHICLE LAMP BASE HAVING INTEGRALLY FORMED SPRING TO BIAS REFLECTOR

CROSS REFERENCE TO RELATED APPLICATIONS

This application claims priority to our U.S. provisional application Ser. 63/069,691, whose contents are incorporated by reference as if fully set forth herein.

TECHNICAL FIELD

The present disclosure relates to automotive headlamps having a light source formed as a replaceable lamp capsule received at a reflector socket in a motor vehicle, and a spring feature in the lamp base.

BACKGROUND

It is known that a vehicle lamp capsule has a separate piece-part metal bias spring disposed in the lamp capsule base and positioned to act between, on the one hand, the lamp capsule, and, on the other hand, the internal wall within the lamp-receiving neck or socket of the reflector base, so as to press between the reflector and the lamp capsule in a direction orthogonal to the lamp axis. Such separate piece-part springs are known, for example, in U.S. Pat. No. 5,855,430 (Coushaine) at FIG. 1, spring 52 and described therein at column 5, lines 5-42. Similar springs are known in U.S. Pat. No. 6,254,252 (Coushaine) at FIGS. 6, 8, and 12 depicting spring 400 and therein at col. 9, ln. 23-33.

It is known that in H13-style lamps that regulations, such as those in the United States at 49 CFR Part 564, require the presence of a spring that is used to preload the lamp within the reflector to enhance the repeatability of the location in which the capsule filament is placed into the reflector and in turn enhance the beam pattern of the system. Analogous regulations exist in other countries, such as regulation ECE R37. The spring is conventionally a separate component that must be manufactured and assembled into the lamp. An example of a lamp specification consistent with such regulation in the U.S. is shown in the National Highway Traffic Safety Administration (NHTSA) Memorandum dated Jun. 26, 2002 archiving in the public record the Osram Sylvania Inc. specification under Part 564, Replaceable Light Source Information, at NHTSA Docket entry No. 98-3397-050, and containing ten data and drawing sheets H13-0 to H13-9, which is incorporated here in in its entirety as if fully set forth herein.

Conventional headlamp capsules, illustrated in U.S. Pat. No. 6,254,252 (Coushaine); U.S. Pat. No. 5,855,430 (Coushaine); U.S. Pat. No. 10,066,801 (Rice); U.S. Pat. No. 9,739,439 (Landcastle et al.), each being of the present Applicant's assignee, and that illustrated in U.S. Pat. No. 6,260,986 (Helbig) and U.S. Pat. No. 5,957,569 (Helbig) of the present Applicant's assignee's parent corporation, are known, and each such document is incorporated here in their entirety as if fully set forth herein. Commercial embodiments of such headlamp capsules as seen at Coushaine Pat. '252 at FIGS. 1-5 are generally designated in the trade as, for example SAE type 9005 or 9006 capsules (also known as HB3 and HB4, respectively), which are generally L-shaped, and embodiments of FIGS. 7-11 therein (or at Coushaine Pat. '430 at FIG. 4) are generally designated in the trade as, for example SAE type 9008 (or H13), which are generally straight. Also known is published application DE 10 2007 015 925 (Helbig), showing another separate piece-part spring, which states it is a construction variant of the spring shown in his own U.S. Pat. No. 6,260,986 (Helbig) and having a wider abutment flange.

Other conventional lamp arrangements are known in U.S. Pat. No. 4,740,876 (Roller); Pub. US2006/0098443 (Kaandorp); and document CN 207438161U at FIG. 1 therein.

SUMMARY

To realize a more reliable and lower cost headlamp capsule, present Applicants herein proposed and recognized the benefit of an integral spring that is formed monolithically with the lamp capsule base, whether the base is formed of plastics material such as by molding, or formed of sheet metal by stamping and folding and/or rolling.

As shown in U.S. Pat. No. 5,855,430 (Coushaine) of the present Applicant's assignee, which is incorporated by reference in its entirety as if fully set forth herein, in a conventional lamp capsule the separate piece-part metal spring (part 52 therein) is located close to electrical leads (leads 90 therein). Applicants herein appreciated that a potential failure mode with the current construction is that the metal spring sometimes can come loose and be displaced within the cavity that it shares with electrical connections to the filament coil and so cause a short circuit and a blown fuse, with the result being one or more lamps in an automobile cease to function and impair visibility.

Applicants herein appreciated that the failure mode described above can be mitigated on the assembly line through use of a 100% automatic test and inspection system to validate that the spring has been installed and provides the prescribed reaction force to validate that is has been installed correctly. With inspection comes a finite percentage of "false failure" occurrences or rejection of suitable good parts whenever, out of an abundance of caution, the inspection system were tuned towards reacting to the "false failure" side of the spectrum rather than to the "undetected failure" side of the spectrum. This leads to a higher scrap rate than should be justified.

The present embodiments remove a failure mode of the conventional lamp. Having reference to FIG. 3, a finite, even if low, percentage of springs in conventional "separate" metal spring lamp capsule assemblies can dislodge themselves in the field, e.g. those installed in vehicles and subject to abuse or excessive vibration. A certain amount of such dislodged springs can result in the metal spring contacting the leadwires while the lamp is energized and cause a short circuit and blown fuse. In present embodiments, having the spring monolithically molded with the base from the same dielectric material as the base eliminates this risk. Furthermore, if such a plastic spring were to break, such as through abuse, it cannot cause an electrical short circuit.

In some embodiments a suitable spring is formed integrally as part of the base. As shown herein this is accomplished by a molded spring, molded monolithically of the same plastics material as the base, resulting in a unitary piece. Such a fabrication will place the contact radii in the proper location as called for in the relevant regulations for the lamp. The length of the "beam" forming the spring is suitably chosen by the size of the slide in conventional tooling that forms the aperture or "window" (about 10 mm) in conventional bases through which the current separate piece-part metal spring emerges, in order to adapt existing tooling and minimize capital expenditure. By designing to such a length of about 8-10 mm based on mold considerations, the cross section of the curved beam is chosen to provide enough deflected force as needed by applicable regulations, such as a minimum of about 9 N (circa 2 pounds) of force, while allowing the compliance of being able to meet the clearances of the regulation without yielding or breakage. A person of ordinary skill realizes that an allowable choice for the beam length is made in light of a design choice of molding tooling to fabricate the lamp base using ordinary skill in the molding art, which affords any process window as desired for the beam length.

Because the curved beam is integrally molded into the plastic base as a monolithic or unitary piece, less material is needed to form "bosses" or shelf surfaces to support a separate metal spring that would be braced internally within the lamp base, such as by being ordinarily braced not only at its two opposed terminal ends but also at two intermediate regions adjacent its projecting "nose" to prevent misalignment of the spring, such as by shock, overloading, or torsion. Herein, FIG. 3 shows such conventionally required bosses or shelves 11. Applicants herein realized as a result of monolithic molding of the spring a reduction in resin needed in a mold of at least about 4%, resulting in direct cost savings. The heretofore customary 100% test and inspection can be reduced or eliminated, and there is also less assembly line downtime and scrap, thus reducing assembly and marginal costs.

In other embodiments similar to H8-16 style lamps, a metal spring is formed monolithically as part of a metal sleeve portion of the lamp capsule base, which in turn is attached to an L-shaped plastic lamp base socket portion that establishes electrical connection to vehicle wiring. In any embodiment, the resultant lamp capsule assembly is inserted in the conventional twist-and-lock manner and retained in a vehicle reflector.

In embodiments, a reflector, which accepts a conventional lamp capsule that has a sealing gasket, has a reflector optical surface in the reflector cavity and a neck defining a bore which extends in an axial direction between a neck entrance region and a neck exit region, the neck exit region being proximate the optical surface. The neck entrance region is configured to accept the lamp capsule and opens to an exterior region exterior of the reflector. The reflector and/or neck has a socket region which receives the lamp capsule that is positioned in the bore, the socket region further having capsule latching structure to retain the lamp capsule. A gasket seating surface, located along the neck axially and which may be axially separated from the capsule latching structure, is adapted to receive the lamp gasket of the lamp capsule. Further embodiments and advantages are discussed hereinbelow.

BRIEF DESCRIPTION OF FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION INCLUDING BEST MODE OF A PREFERRED EMBODIMENT

Figure 1:
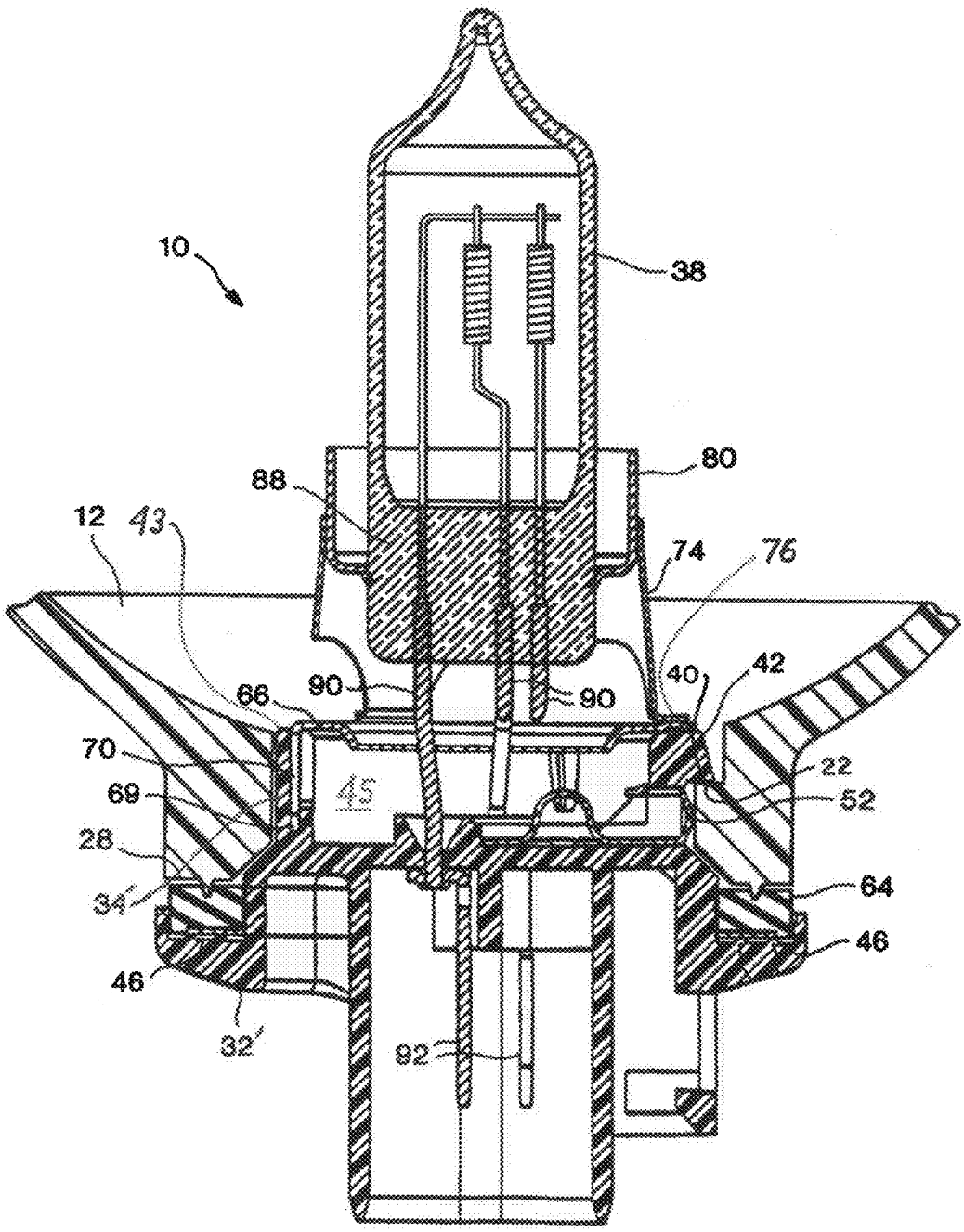
FIG. 1 PRIOR ART
FIG. 1 (Prior Art) is a cross-sectional view of a vehicle headlamp system partially broken away.

It may be appreciated that the present disclosure is not limited in its application to the details of construction and the arrangement of components set forth in the following description or illustrated in the drawings. The embodiments herein may be capable of being practiced or being carried out in various ways. Also, it may be appreciated that the phraseology and terminology used herein is for the purpose of description and should not be regarded as limiting as such may be understood by one of skill in the art.

The automotive headlamp 32 disclosed herein is suitable for use on a motor vehicle, particularly in the reflector cavity for the vehicle forward lighting such as the vehicle headlamp or fog lamp (collectively be referred to herein as a vehicle headlamp) which is used to illuminate a road surface. The type of motor vehicle may include, but is not limited to, a land vehicle such as a passenger sedan, a sport utility vehicle, a minivan, a truck (light or heavy truck) and a recreational vehicle (e.g., ATV, motorcycle, snowmobile). Alternatively the motor vehicle may also include water vehicles (e.g. boats, jet-skis, personal water craft) and air vehicles (e.g. planes, helicopters).

FIG. 1 to FIG. 4 show a prior art lamp capsule 32' as known in U.S. Pat. No. 5,855,430 (Coushaine) of the present Applicant's assignee, which is incorporated by reference in its entirety as if fully set forth herein. FIG. 1 shows a cross sectional view of a preferred embodiment of a vehicle headlamp system partially broken away. Like reference numbers designate like or corresponding parts throughout the drawings and specification. The vehicle headlamp system 10 is assembled from an optical reflector 12, lamp capsule 32', and gasket 64. Additional mounting, aiming, sealing, venting, and similar headlamp features may be selected or used according to designer choice as known in the art.

Figure 2:
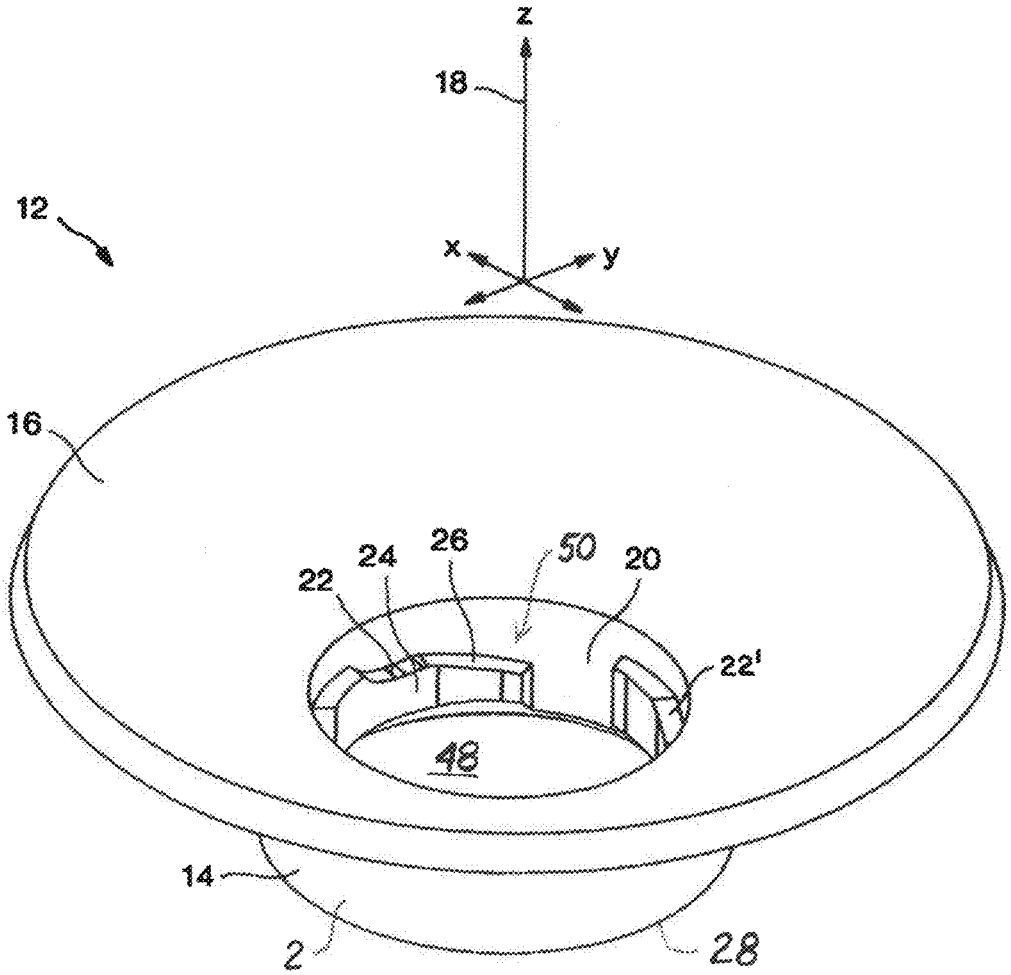
FIG. 2 PRIOR ART
FIG. 2 (Prior Art) is a perspective view of a vehicle reflector 12.

FIG. 2 shows a perspective view of an optical reflector 12, partially broken away. Reflector 12 is typically mounted to a vehicle chassis. Optical reflector 12 may be made of molded plastic, such as a filled bulk molding material, as known in the art. Reflector 12 has the general form of a concave shell with an exterior (or rear) side 14 and an interior, or forward reflective side, referred to as optical surface 16. Optical surface 16 provides a desired headlamp beam pattern as known in the art. Optical surface 16 may be coated, if necessary, with various reflective and protective layers, not shown.

Extending in a forward direction from the optical surface 16, is an optical axis 18 ("Z-axis"), generally indicating the direction of the final headlamp beam. It is understood that the reflector 12 may be enclosed on the front side by a clear cover lens (not shown) that may, optionally, include beam directing lens elements. Reflector 12 may be supported by aiming hardware, and enclosed in a housing as is known in the art.

The optical reflector 12 also has an internal wall 20 defining within neck 2 a passage or bore 48 extending axially between exterior surface 14 and optical surface 16. Formed on the internal wall 20 are one or more axial positioning surfaces 22, and one or more planar positioning surface 24. The axial positioning surface 22 then provides a locating surface that the lamp capsule 32' can be positioned against for proper location of lamp capsule 32' in the axial direction 18 (Z-axis direction). The axial positioning surface 22 may be formed as a depression or concavity on an in-leading ramp or camming surface 26 facing in the forward axial direction 18 to thereby locate lamp capsule 32' with reference to optical surface 16. Reflector 12 and neck 2 further define socket region 50 that receives and retains lamp capsule 32'. Socket region 50 is located axially spaced from gasket seating surface 28 which comes into abutment with gasket 64 (FIG. 1). Socket region 50 has latching structure comprising wall 20 and positioning surface 22 which provides a cavity having a ledge onto which capsule retaining keys 42 (FIG. 1 and FIG. 4) can be introduced through corresponding slots such as by axial and then slight rotational (so-called "eighth-turn" or "quarter-turn") motion akin to a bayonet latch, for positioning and retention of the lamp capsule, all as is known in the art.

Conventionally, axial positioning surface 22 and lead in ramp 26 are repeated as a pattern in two other locations (a second positioning surface is shown as 22' and a second planar locating surface is shown as 24' the remaining albeit similar surfaces are not shown) around internal wall 20. The in-leading ramps 26, may terminate respectively in notched depressions serving as locating surfaces 22, 22' and a similar one not shown that can then accept radially-extending retaining keys 42 (FIG. 4), which can also be called follower arms 42, extending radially from lamp capsule 32'. The three axial positioning surfaces 22 are located approximately equiangularly around internal wall 20.

Figure 4:
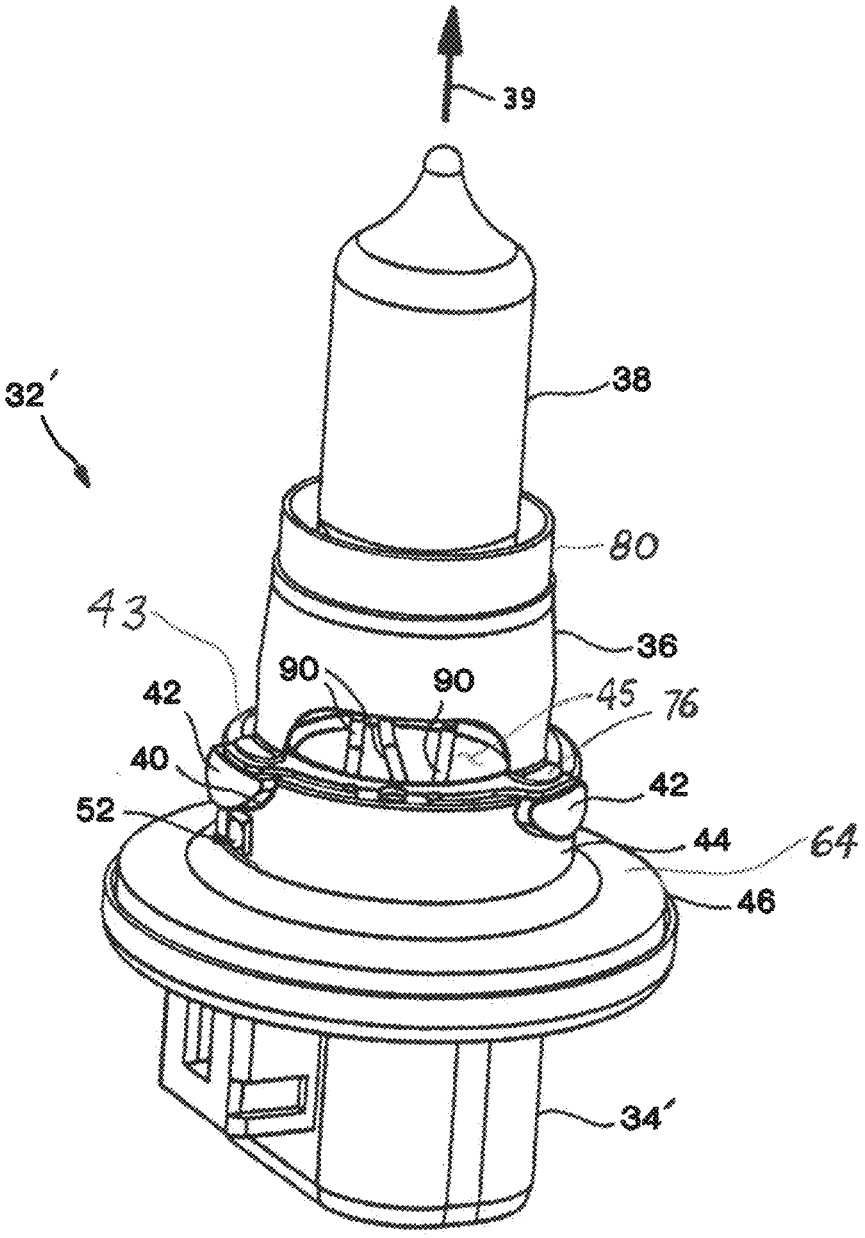
FIG. 4 PRIOR ART
FIG. 4 (Prior Art) is a perspective view of a lamp capsule 32'.

FIG. 4 shows a perspective view of lamp capsule 32'. The lamp capsule 32' may be made with a plastic base 34' of plastic resin, or filled plastic resin. A suitable resin is available under the trade name Amodel A-1145HS, available from the Solvay company, which is a 45% glass-filled, heat stabilized polyphthalamide (PPA) resin. Coupled to plastic base 34' is holder or retainer 36, preferably made of metal or rolled sheet metal, and held in the metal holder 36 is light source 38. The light source 38 has an envelope axis 39 which is an optical axis. The optical reflector 12 is designed to couple and seal with lamp capsule 32'. The lamp capsule 32' has an axial locating surface 40 formed on retaining keys 42, a planar locating wall surface 44, a capsule sealing surface 46, and a bias spring 52. An elastomeric gasket 64 (FIG. 1) is received on sealing surface 46. There are numerous base and metal holder designs allowing for accurate positioning of the light source with respect to the lamp capsule.

The base 34' is approximately a plastic tube adapted with coupling, locating and sealing features that then supports a metal holder 36 that supports light source 38. The light source 38 is conventionally a tungsten halogen lamp bulb. With respect to the axial and planar location features described above in the coupling of the capsule to the reflector, the light source and holding method, and features of supporting the light source 38' to retainer 36 for interconnecting to base 34', are all matters of design choice understood by those of skill in the art. Other light source designs and holding methods may be used with the reflector coupling design.

Conventionally, positioned along lamp capsule 32' is at least one axial locating surface 40, or three. The axial positioning surface 22 of reflector 12 mates face to face with the axial locating surface 40 of lamp capsule 32'. When surfaces 22 and 40 are seated one to the other, lamp capsule 32' is then properly positioned with respect to the optical surface 16 along the optical axis 18 (Z direction). The lamp capsule 32' axial positioning surfaces 40 are the lower (exterior side) facing surfaces of three retaining keys 42, extending orthogonal to lamp axis 39 from lamp capsule 32'. When lamp capsule 32' is inserted in reflector 12, each arm 42 passes inward sufficiently to slide up on a corresponding in-lead ramp 26, formed on reflector 12. By rotating lamp capsule 32', the arms 42 are cammed up ramps 26, thereby advancing lamp capsule 32' along the optical axis (Z direction) while compressing gasket 64. Once arms 42 reach the inner ends of the in-lead ramps 26, the axial locating surfaces 40 abut the positioning surfaces 22, which may be formed with retaining depressions or slots, and are held in place by the resilient compression of gasket 64.

With particular reference to FIG. 1 and FIG. 4, also positioned along lamp capsule 32' is a wall 43 having on its exterior a locating surface 44. Wall 43 extends circumferentially and extends axially along lamp axis 39. The planar positioning surface 24 of reflector 12 mates face to face with wall locating surface 44. When the planar positioning surface 24 and the wall locating surface 44 are properly seated one to the other, lamp capsule 32' is then properly positioned in the X and Y directions with respect to the optical axis 18 (Z direction). The capsule locating surface 44 has a cylindrical face formed on an exterior side of base 34' and extending axially parallel to the optical axis 18. The planar positioning surface 24 of the reflector and the wall locating surface 44 of plastic base 34' are formed to be conformal with each other when lamp capsule 32' is properly positioned in reflector 12.

Positioned along lamp capsule 32' is sealing surface 46. The capsule sealing surface 46 allows lamp capsule 32' to be sealed to the gasket 64, and thereby close off the reflector passage 48. Capsule sealing surface 46 is a ring shape, whose normal is approximately parallel to the optical axis 18. The ring, which may be circular or otherwise, extends around lamp capsule 32' so as to follow along and to mate with the gasket 64 which is also mated to the corresponding reflector sealing surface 28.

Conventionally, retainer 36 can have holding cup 80, which may be sheet metal, formed to engage light source 38. Where light source 38 is a filament lamp having light-emitting coil and press seal 88, retainer 36 can engage press seal 88. Holding cup 80 is supported by pedestal 74 having mounting feet 76 and optionally attached to clip ring 66. Clip ring 66 may be formed of sheet metal and has mounting tongues 70 which mount into an upper region of plastic base 34' such as by retention in notch 69. Optionally retainer 36 or pedestal 74 mounts directly to base 34' at an upper region thereon. A respective mounting foot 76 abuts atop a respective retaining key 42 to connect to base 34' and for stability. In known constructions, retainer 36 may be received somewhat internally within a cavity of base 34' forming passageway 45, or somewhat atop an upwardly-facing lip of base 34'.

Conventionally, base 34' and wall 43 define a cavity or passageway 45 for electrical leads 90 from light source 38 to be received therein to then form an electrical pathway with electrical lugs 92 located in a lower region of base 34' which is typically narrower than the upper region of base 34' supporting the wall. The lower region of base 34' thus provides mechanical and electrical connection to a wiring connector supplying power from the vehicle.

Figure 3:
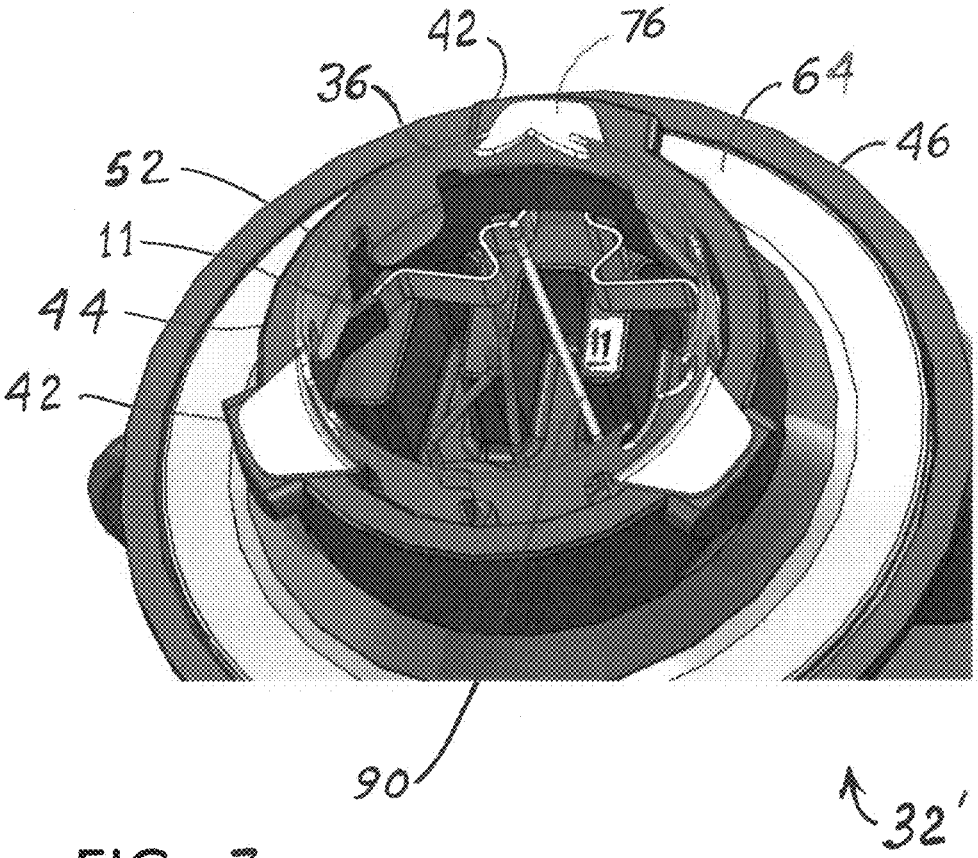
FIG. 3 PRIOR ART
FIG. 3 (Prior Art) is a perspective view, partially broken away, of an H13-style lamp capsule 32' having separate piece-part metal spring 52.

Conventionally lamp capsule 32' includes a bias spring 52. The spring bias 52 is positioned to act between the internal wall 20 and the lamp capsule 32' so as to press between the reflector and the lamp capsule 32 in a direction orthogonal to the lamp axis 18. FIG. 3 shows a perspective view of a conventional spring 52.

A conventional separate piece-part metal spring 52 is shown in FIG. 3 showing a detail cut-away of lamp capsule 32', such as similar to embodiments of lamps sold by Osram Sylvania Inc. designated as the H13-style and sold under the registered trade name Sylvania. The bosses 11, also called shelf surfaces, support separate metal spring 52, such as by bracing it at its two opposed terminal ends and also at two intermediate regions adjacent the projecting "nose" of the spring.

Figure 5:
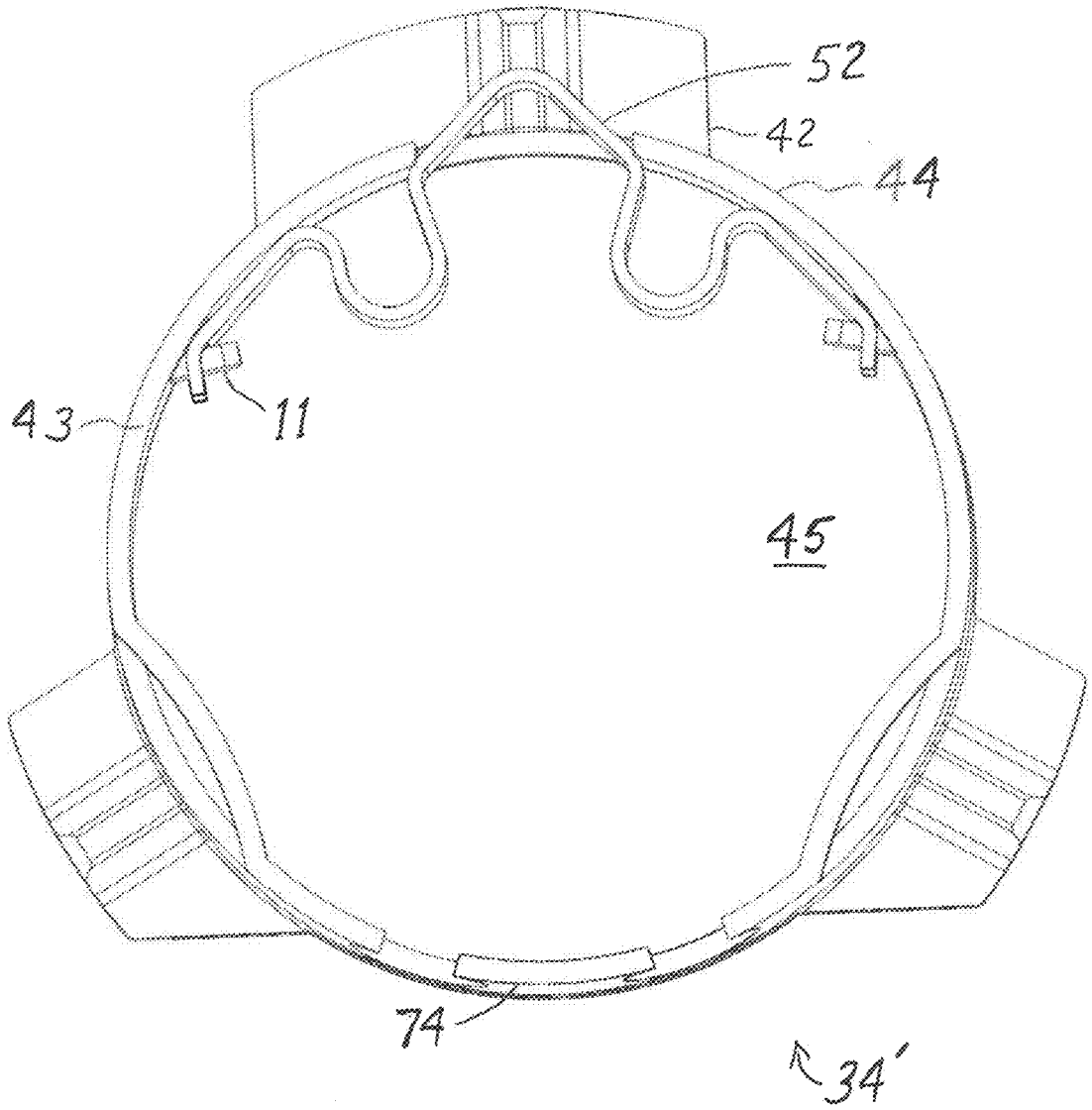
FIG. 5 PRIOR ART
FIG. 5 (Prior Art) is an elevational view, partially broken away, of another lamp capsule base 34' for H8-16 style lamps having separate piece-part metal spring 52.
Figure 6:
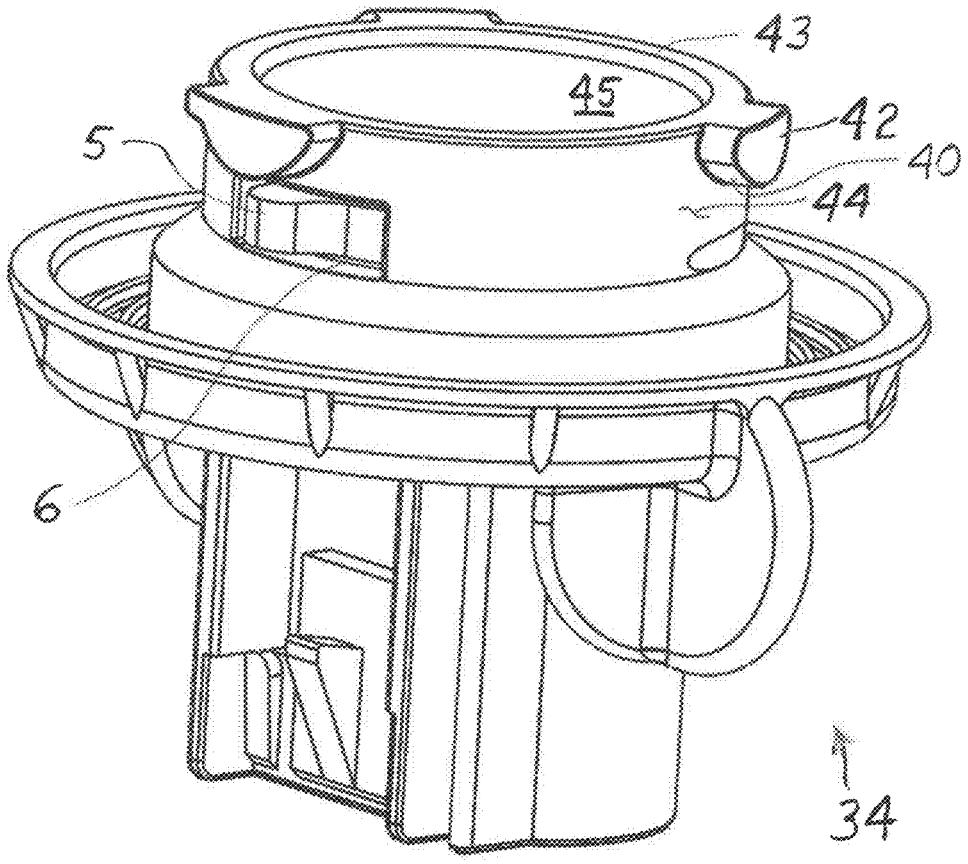
FIG. 6 is a perspective view of lamp base 34 showing molded spring 5 formed with wall 43.

In an alternate conventional construction of lamp capsule 32' illustrated in FIG. 5, showing a detail cut-away view of base 34' sectioned above the spring (in a direction towards the narrow proximal end of base 34' having the electrical contact lugs 92), the plastics material portion of base 34' does not have retaining keys 42 molded into it, but rather retaining keys 42 are formed of sheet metal, typically in one integral part monolithically formed with sheet-metal retainer 36, and the resulting part mated to the plastics material lower portion of base 34' containing electrical contact lugs 92 for making contact with an external power supply.

In present embodiments shown in FIGS. 6-15, and having particular regard to the foregoing description of overall construction of a lamp capsule and operation of the lamp capsule in the reflector, like reference numerals connote like structure and operation of parts, the difference to the prior art lamp capsules 32' discussed hereinabove residing in the difference of the construction of the bias spring.

FIGS. 6-10 show base 34 molded of a plastics material and having spring 5 molded integrally into wall 43 of the base. The spring 5 is molded monolithically with base 34. Such monolithic molding of spring 5 with the remaining portions of wall 43 can be said to result in a unitary part. Spring 5 on base 34 is molded with at least one reflector-locating structure also on base 34, such as circumferential exterior locating surface 44 or retaining keys 42, or optionally both locating surface 44 and retaining keys 42. Monolithic molding of spring 5 on base 34 with locating surface 44 can advantageously reduce misalignment or tolerance between the outer peripheral position of spring 5 and locating surface 44 which locates capsule position into reflector 12. Preferably, retaining keys 42 are also molded as part of tubular wall 43. Cavity or passageway 45 in wall 43 accommodates electrical leads 90. The wall 43 defines a circumferentially extending exterior locating surface 44, as described hereinabove. Spring 5 is formed in an aperture 6 defined in wall 43. Spring 5 can be configured as a curved beam. Spring 5 is preferably formed as a cantilevered beam, connected at one lateral side, being a proximal beam end, of aperture 6; thus, the distal end of spring 5 is a free end. Alternatively a beam forming spring 5 could be formed as a film or bulge from wall 43, connected at more than one side of the beam.

Figure 7:
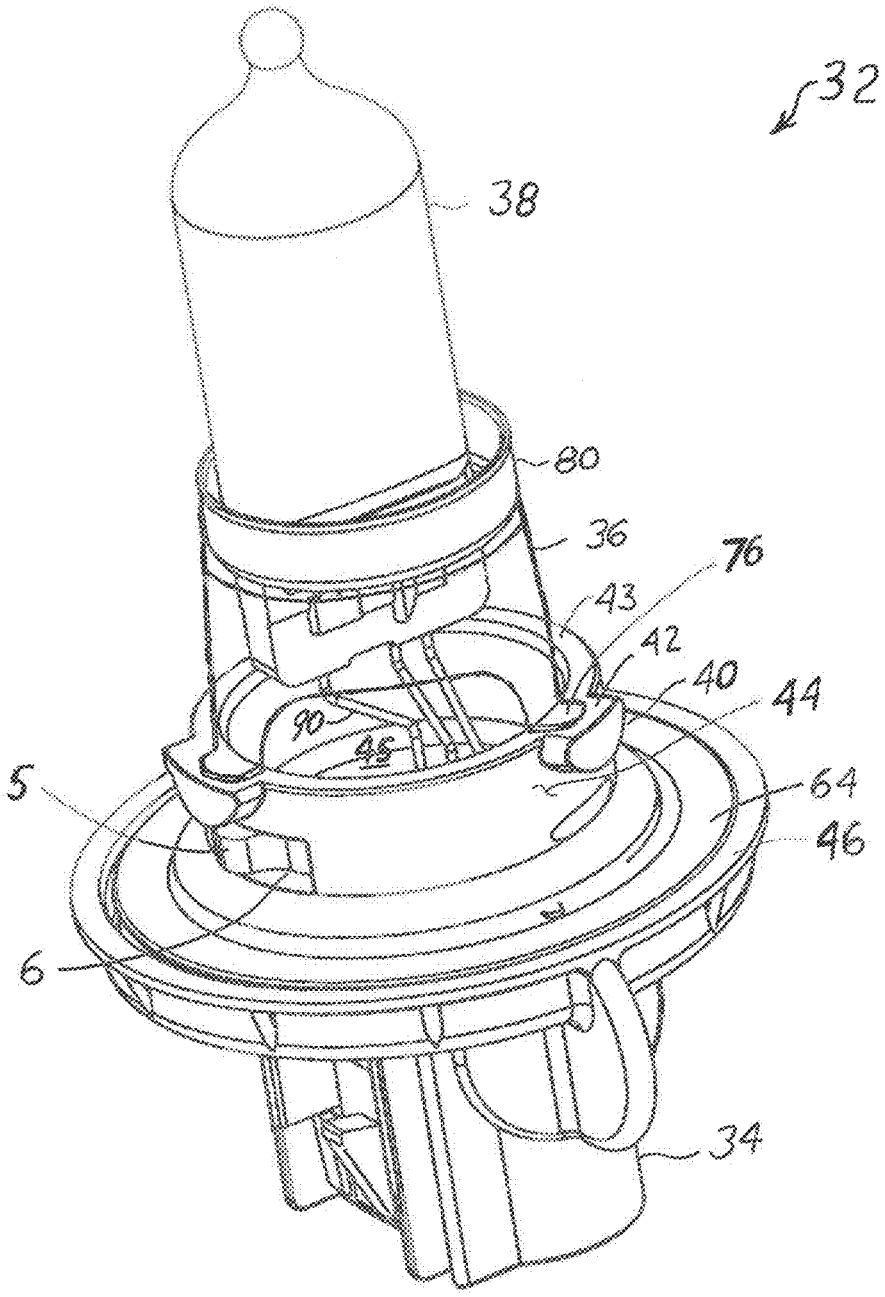
FIG. 7 is a perspective view, partially broken away, of lamp capsule 32 with base 34 of FIG. 6.
Figure 8:
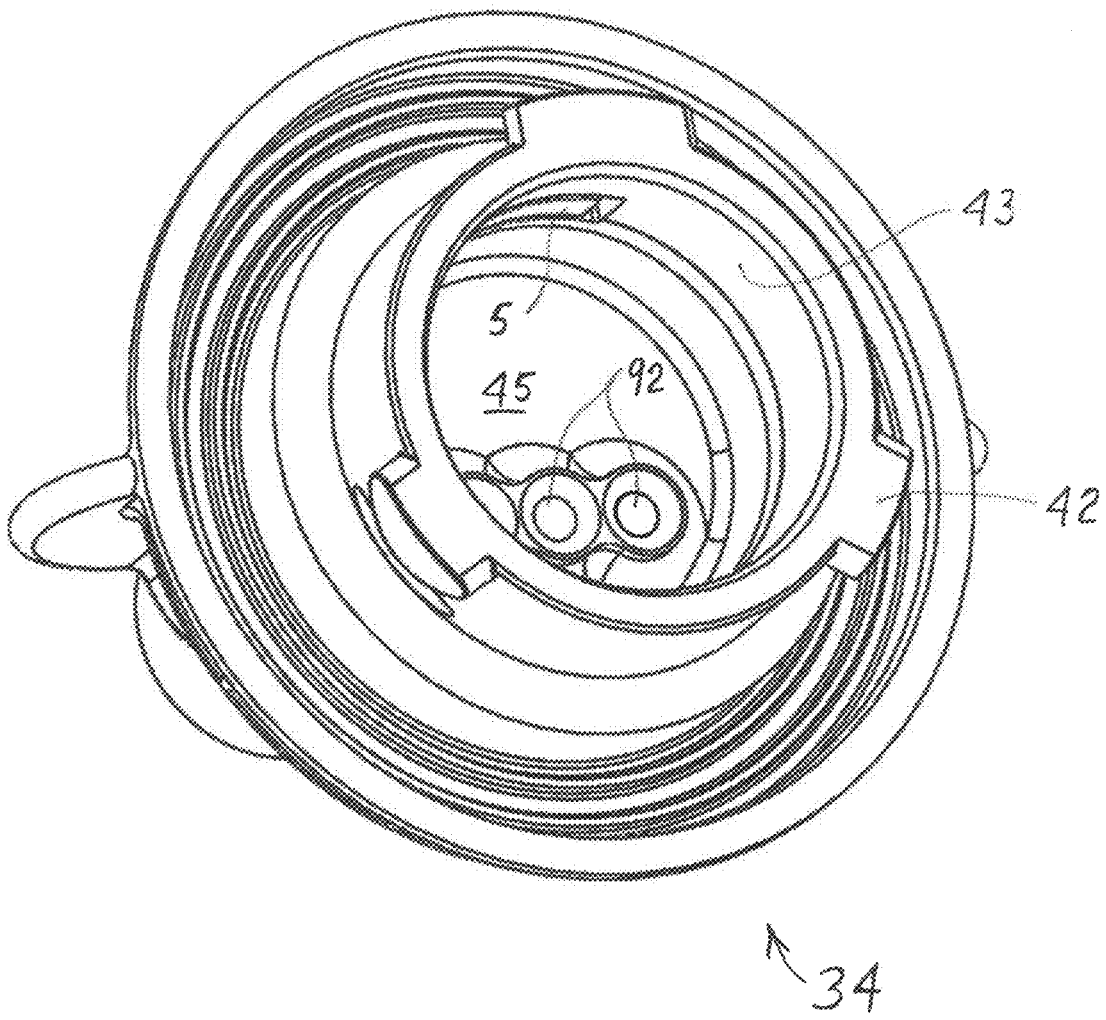
FIGS. 8-9 are top perspective views of FIG. 6, FIG. 9 being broken away.
Figure 9:
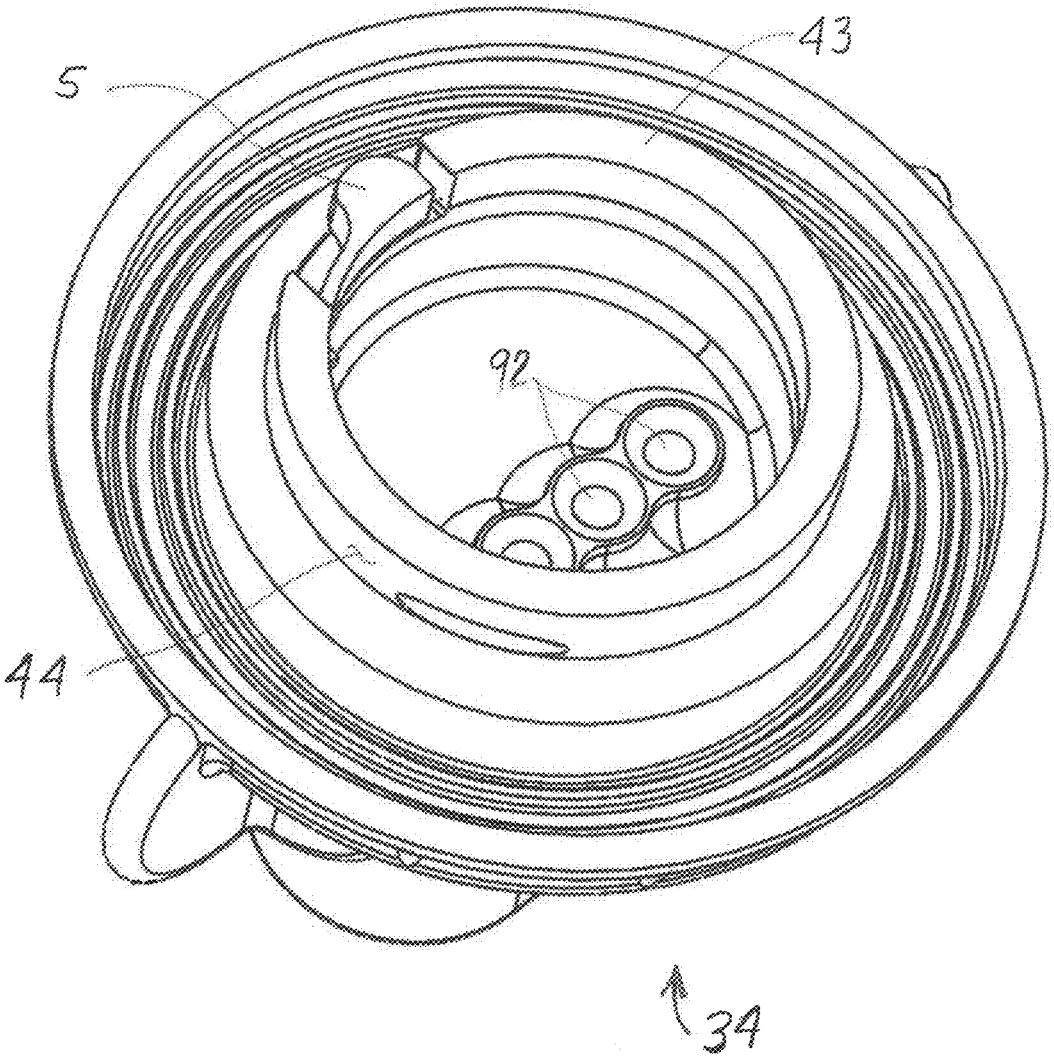
Figure 10:
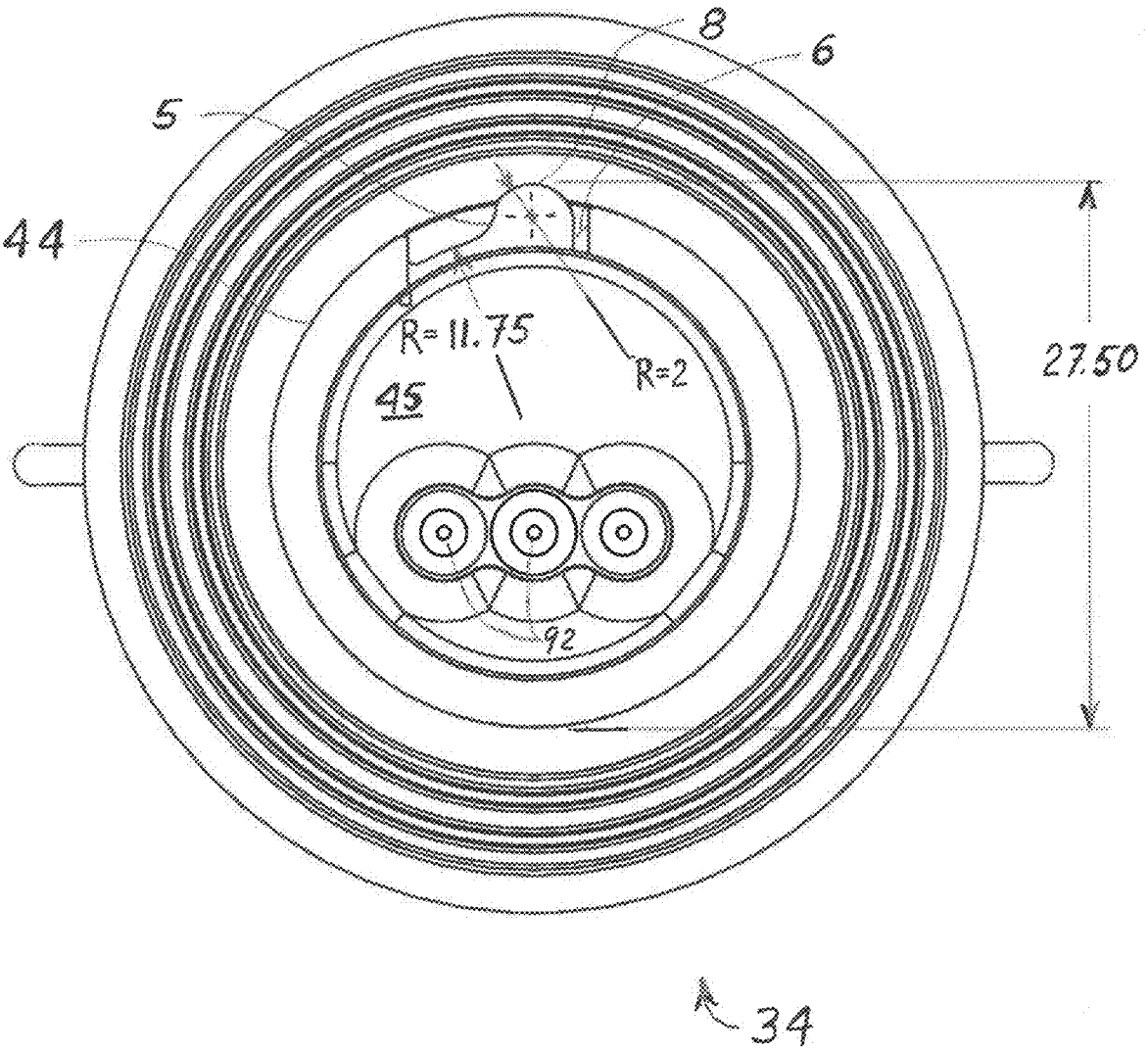
FIG. 10 is a rear cross-sectional view of FIG. 6 showing spring beam 5.
Figure 11:
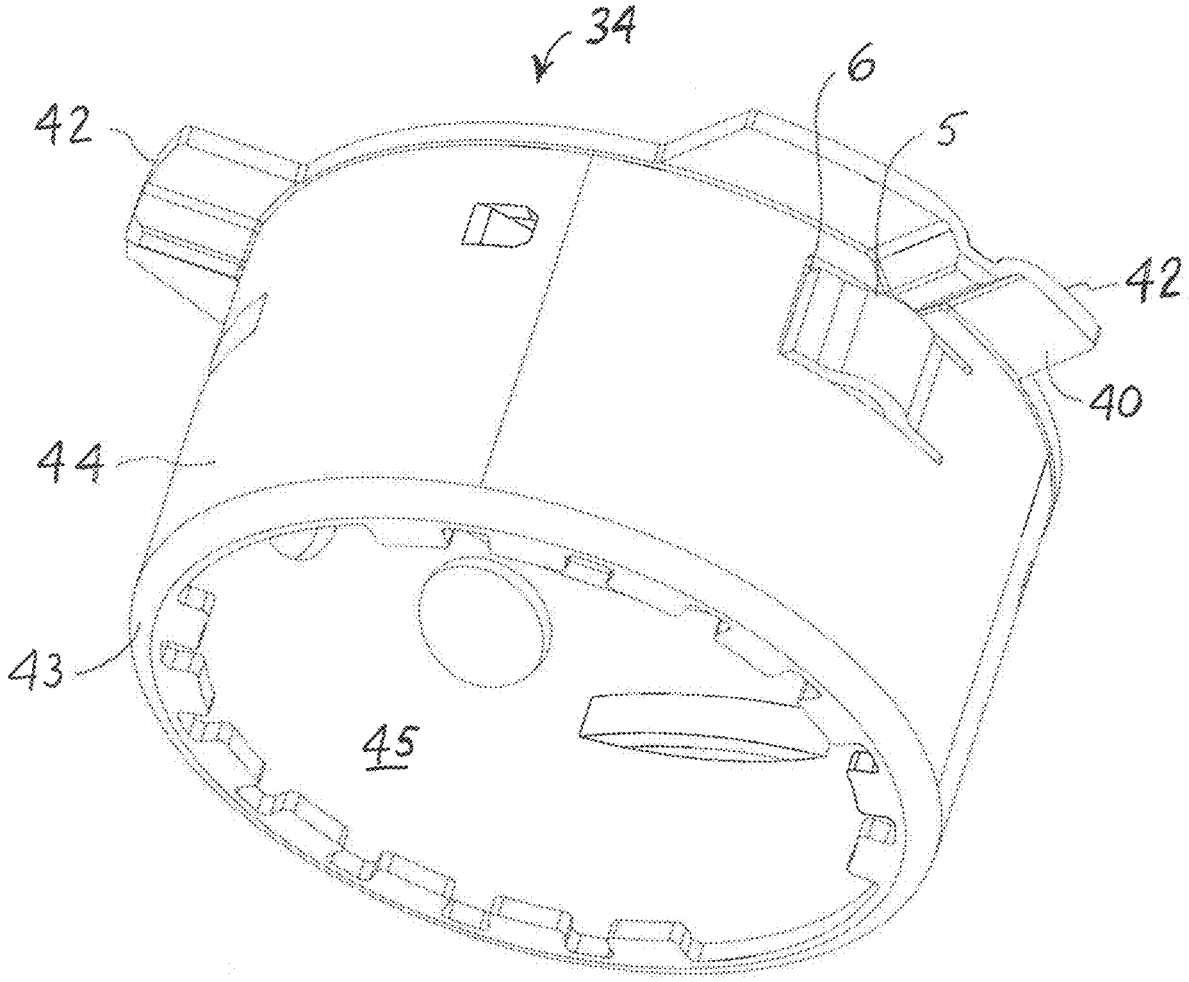
FIGS. 11-12 are perspective views of another embodiment of lamp base 34 showing spring 5 formed with wall 43 of sheet metal such as for H8-16 style lamps.
Figure 12:
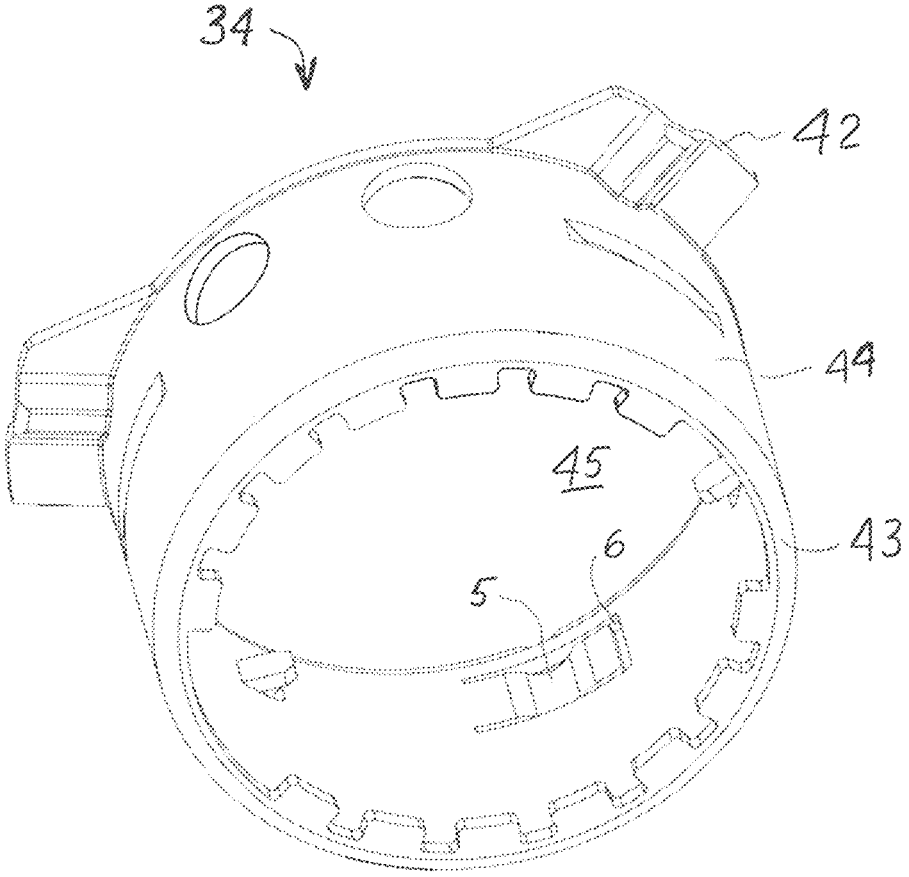

As shown in FIG. 7, light source 38 can be a filament lamp. Such filament lamps have an envelope wall, typically made of glass, defining an enclosed volume within which the light-emitting filament is located. Such a lamp can have a press seal 88 closing the enclosed volume, and electric leads 90 for the light source extend from the enclosed volume through press seal 88. Such electric leads 90 connect to electrical contact lugs located within a passageway at a lower region of base 34. Alternatively it is understood that light source 38 could be formed as a solid-state light source such as one or more light-emitting diodes (LEDs) located within a spatial envelope and which are arranged with respect to an optical axis 39 and are supplied by analogous electric leads 90, but without a press seal 88; in such an arrangement, a retainer 36 would be suitably adapted to support an LED light source, as is understood by the ordinary worker in the art.

FIGS. 7-10 show that spring 5 can be flush or approximately flush with an interior surface of wall 43 where a cavity or passageway 45 for electrical leads is defined, thus avoiding an interference with electrical leads disposed therein. Advantageously, Applicant's embodiments avoids the conventional support bosses 11 (contrast FIGS. 3, 5).

Base 34 and spring 5 can be molded as one unitary part, molded of conventional glass-filled resin such as the resin available under the trade name Amodel A-1145HS, available from the Solvay company, which is a 45% glass-filled, heat stabilized polyphthalamide (PPA) resin. The spring 5 can suitably have the dimensions shown in FIG. 10, which is a sectional view taken above spring 5. At the distal end of the spring-beam, the spring 5 has a radially outwardly facing protuberance or nose 8. The nose 8 may be thicker, in a width direction transverse optical axis 39, then the thickness of the beam along most of its length that defines spring 5. The nose 8 extends radially outward of the exterior locating surface 44 of wall 43. An overall diameter from an outer surface of nose 8 to the opposite side of exterior locating surface 44 is about 27.5 mm. Therefore the outermost surface of nose 8 of spring 5, in rest or neutral position, extends about 0.8 or 1 mm beyond outer surface 44 adjacent to aperture 6 and spring 5. Spring 5 may be curved, preferably continuously curved, along its length. Spring 5 may be suitably radiused at transition regions at its distal end to form nose 8, such as by having a relief radius. The outwardly-facing surface of nose 8 is suitably radiused to smoothly engage relevant surfaces of reflector 12, such as with an outwardly-convex radius of about 2 mm, as shown. Spring 5 may be curved along its length at a radius of about 11.75 mm centered on the internal cavity or center of exterior surface 44, as shown. Applicants herein determined that when spring 5 was molded as described herein and was then deflected at about 1.08 mm, the deflection force was generally at least about 11.7 N, thus satisfying, and exceeding, the lower regulation limit of 9 N. One of ordinary skill in the art using no more than conventional knowledge understands to choose suitable dimensions of length, width and height of the beam forming integral-molded spring 5 to achieve a desired deflection force.

Figure 13:
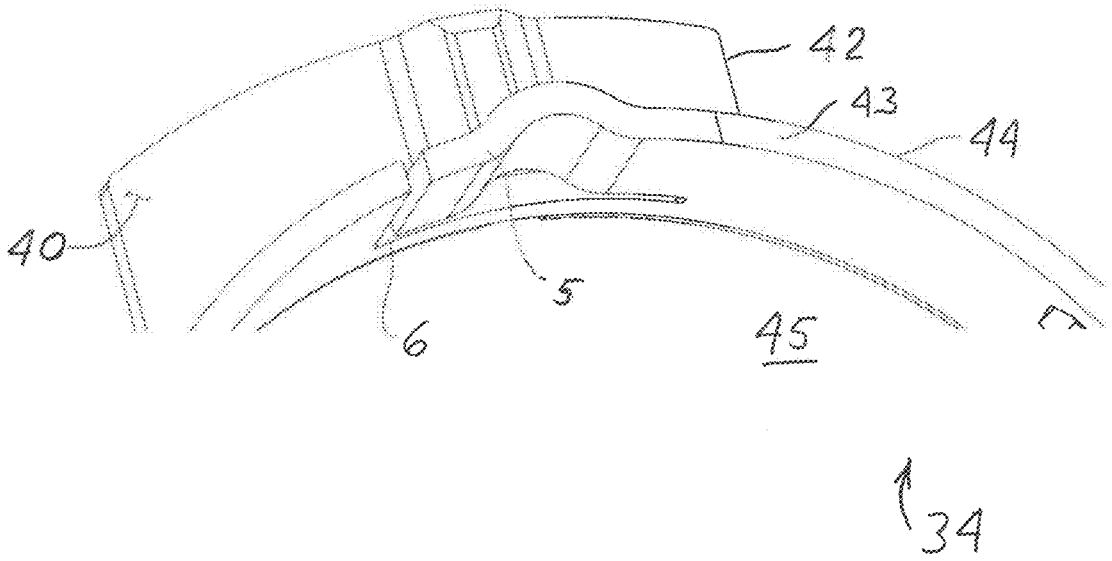
FIG. 13 is a perspective view, partially broken away, of FIG. 11.
Figure 14:
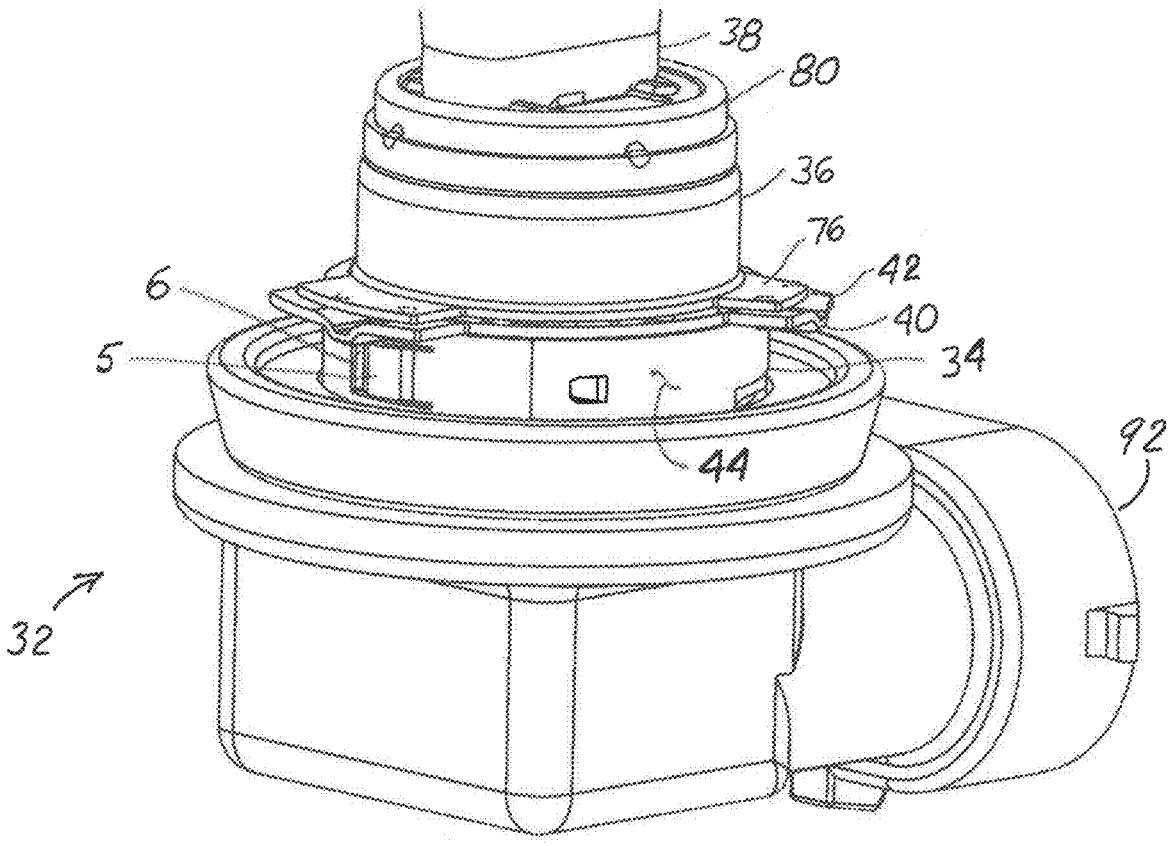
FIG. 14 is a perspective view of lamp capsule 32 with base of FIG. 11.
Figure 15:
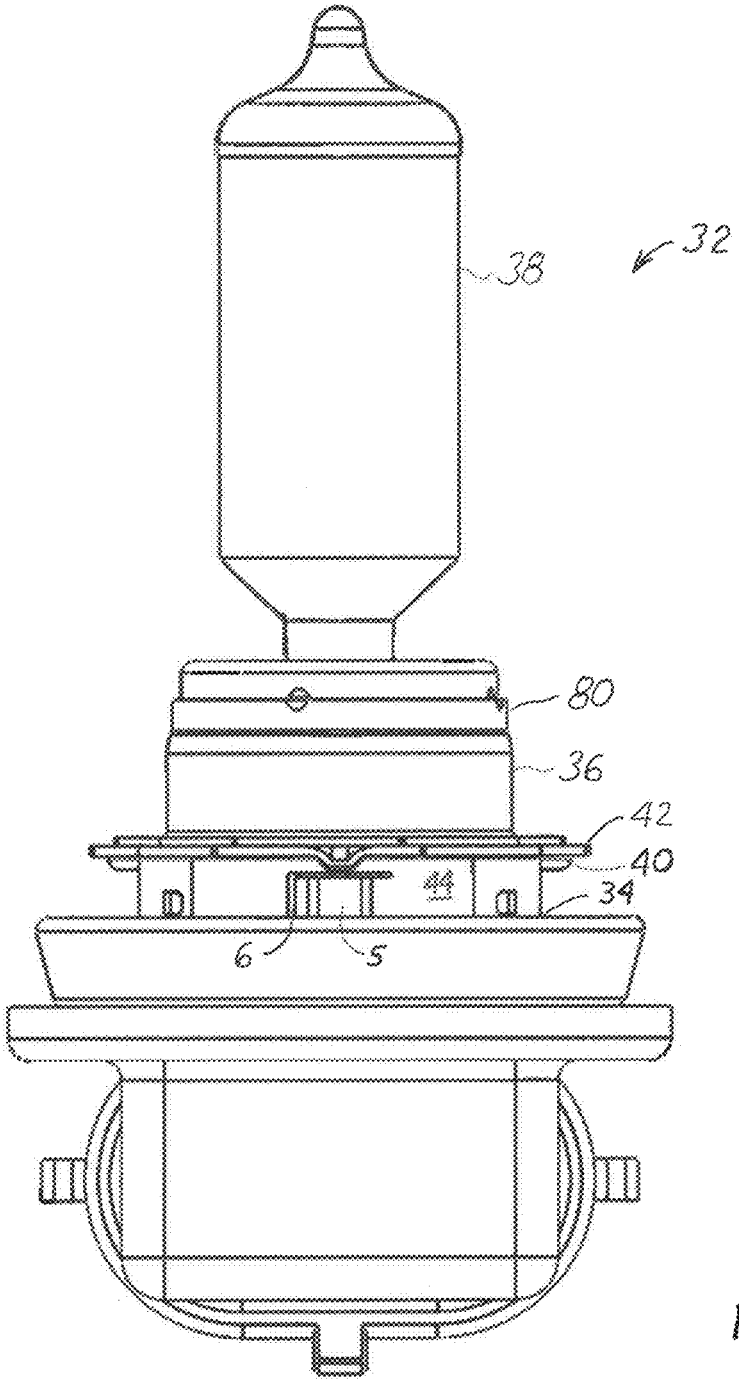
FIG. 15 is a front elevational view of lamp capsule 32 of FIG. 14.

In an embodiment shown in FIGS. 11 to 15, a portion of base 34 is formed of a sheet material, with spring 5 formed of one piece with the sheet material that forms wall 43 and outer surface 44. This construction is useful in lamps conventionally designated as the H8-16 style. The sheet material may suitably be sheet metal, a material similar to that of metal retainer 36 to retain light source 38. As shown in FIG. 13 showing in detail a cross-sectional view cut transverse to optical axis 39 just above the spring beam, spring 5 may suitably be flush with inner surface of wall 43 to provide clearance in passageway 45 for electrical leads 90 (not shown). To assemble lamp capsule 32, base 34 is coupled to a lower socket portion to connect electrical contact lugs 92 (see FIGS. 14-15), and formed to make mechanical and electrical connection to a wire connector supplying power from the vehicle.

While a preferred embodiment of the present disclosure has been described, it should be understood that various changes, adaptations and modifications can be made therein without departing from the spirit of the disclosure and the scope of the appended claims. The scope of the disclosure should, therefore, be determined not with reference to the above description, but instead should be determined with reference to the appended claims along with their full scope of equivalents. Furthermore, it should be understood that the appended claims do not necessarily comprise the broadest scope of the disclosure which the applicant is entitled to claim, or the only manner in which the disclosure may be claimed, or that all recited features are necessary.

The following is a non-limiting list of reference numeral used in the specification:

2 reflector neck
5 spring (FIGS. 6-15)
6 aperture (FIGS. 6-15)
8 nose of spring 5
10 vehicle headlamp system
11 boss (shelf) (FIG. 3)
12 reflector
14 exterior of reflector
16 inner optical surface of reflector
18 axis (optical)
20 internal wall
22 axial positioning surface
22' axial positioning surface
24 radial positioning surface
26 lead-in ramp (camming portion)
28 gasket seating surface
32 lamp capsule
32' lamp capsule (FIGS. 1, 4)
34 base of lamp capsule
34' base of lamp capsule (FIGS. 1, 4)
36 retainer
38 light source
39 light source axis
40 axial locating surface (cammed surface)
42 retaining key (follower arm)
43 wall
44 lamp capsule outer locating surface
45 passageway (cavity)
46 capsule (gasket) seating surface
48 bore of neck
50 socket
52 separate piece-part bias spring (FIGS. 1, 3, 4)
64 gasket
66 clip ring
69 mounting notch
70 tongue
74 pedestal
76 mounting foot
80 cup
88 press seal
90 electrical lead
92 electrical contact lug

What is claimed is:

1. An automotive lamp capsule (32) adapted to be received in a vehicle lamp reflector (12) mounted to a vehicle chassis, the lamp capsule comprising:

a lamp base (34);

a light source (38) having an envelope defining an optical axis (39) extending from a proximal end adjacent the lamp base to a distal end, and wherein electric leads (90) for the light source extend from the envelope through the proximal end;

the base (34) having a wall (43) defining a passageway (45) for the electrical leads (90) to be received therein to form an electrical pathway for connection to an external power supply to energize the light source; and a retainer (36) interconnecting the light source (38) and the base (34);

wherein the wall (43) of the base further defines a circumferentially extending exterior locating surface (44) configured to abut an interior socket surface (24) of the automotive lamp reflector (12), the wall of the base further comprising a spring (5) formed monolithically with the wall, said spring (5) extending radially beyond the exterior locating surface (44).

2. The lamp capsule of claim 1, wherein the lamp base comprises retaining keys (42) extending radially from the lamp base (20).

3. The lamp capsule of claim 2, wherein the retaining keys (42) are formed monolithically with the wall of the lamp base.

4. The lamp capsule of claim 1, wherein the exterior locating surface (44) extends axially in a direction of the optical axis (39).

5. The lamp capsule of claim 4, wherein the spring is formed within an aperture (6) defined in the wall (43), the spring attached to one side of the aperture and extending therefrom transverse to the lamp optical axis (39).

6. The lamp capsule of claim 5, wherein the lamp base (34) and spring (5) are molded of a plastics material.

7. The lamp capsule of claim 1, wherein the wall (43) of the base is generally tubular.

8. The lamp capsule of claim 1, wherein the retainer (36) is formed as a separate component from the base (34) and comprises attachment structure (70; 76) formed to couple to the base.

9. The lamp capsule of claim 1, wherein the spring (5) defines a curved beam.

10. The lamp capsule of claim 1, wherein the spring (5) defines a cantilevered beam.

11. The lamp capsule of claim 1, wherein a distal end of the spring (5) defines a nose (8) extending radially outward of the wall exterior locating surface (44).

12. The lamp capsule of claim 1, wherein the wall (43) defines an aperture (6), the spring (5) being disposed in the aperture.

13. The lamp capsule of claim 12, wherein the spring (5) is attached at a lateral side of the aperture (6).

14. The lamp capsule of claim 13, wherein the spring (5) is cantilevered in the aperture.

15. The lamp capsule of claim 13, wherein a distal end of the spring (5) defines a nose (8) extending radially outward of the wall exterior locating surface (44).

16. The lamp capsule of claim 14, wherein a distal end of the spring (5) defines a nose (8) extending radially outward of the wall exterior locating surface (43).

17. The lamp capsule of claim 1, wherein the lamp base (34) is molded of a plastics material.

18. The lamp capsule of claim 1, wherein the lamp base (34) is formed of a sheet metal.

19. The lamp capsule of claim 1, wherein the light source (38) further comprises a filament configured to emit light when energized, the envelope defining an enclosed volume within which the filament is disposed.

20. The lamp capsule of claim 2 in combination with the vehicle reflector (12), the reflector (12) having a neck (2) adjacent a reflective surface (16), the neck defining a bore (48) communicating from an exterior region (14) exterior to the reflector toward an interior region adjacent the reflective surface (16), the lamp capsule (32) having axially oriented camming surfaces (40) defined on respective retaining keys (42), the retaining keys (42) being disposed in an axial direction spaced from the spring (5), whereby the lamp capsule (32) is configured to be introduced into the bore (48) of the reflector neck (2) from the exterior region and retained therein at an axial position in register with corresponding cam surfaces (24, 26) formed on the vehicle reflector.

* * * * *